US011393390B2

(12) United States Patent
Yang et al.

(10) Patent No.: US 11,393,390 B2
(45) Date of Patent: Jul. 19, 2022

(54) ELECTRONIC DEVICE AND BRIGHTNESS ADJUSTMENT METHOD THEREOF

(71) Applicant: ASUSTeK COMPUTER INC., Taipei (TW)

(72) Inventors: Chia-Feng Yang, Taipei (TW); Yi-Ching Chen, Taipei (TW); Chia-Lei Yu, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 17/301,858

(22) Filed: Apr. 16, 2021

(65) Prior Publication Data

US 2021/0343259 A1 Nov. 4, 2021

Related U.S. Application Data

(60) Provisional application No. 63/017,135, filed on Apr. 29, 2020.

(30) Foreign Application Priority Data

Feb. 1, 2021 (TW) ..... 110103720

(51) Int. Cl.
*G09G 3/32* (2016.01)

(52) U.S. Cl.
CPC ..... *G09G 3/32* (2013.01); *G09G 2320/064* (2013.01); *G09G 2360/16* (2013.01)

(58) Field of Classification Search
CPC ..... G09G 5/10; G09G 2360/16; G09G 2320/0646; G09G 2320/064; G09G 3/32; G09G 2320/062; G09G 2320/0626; G09G 3/3406
See application file for complete search history.

(56) References Cited

U.S. PATENT DOCUMENTS

| | | | | |
|---|---|---|---|---|
| 8,207,953 | B2 | 6/2012 | Yamamura et al. | |
| 10,878,762 | B2 | 12/2020 | Shi et al. | |
| 2008/0143757 | A1* | 6/2008 | Furihata | G09G 3/3406 345/690 |
| 2012/0038290 | A1* | 2/2012 | Choi | H05B 45/38 315/293 |

(Continued)

FOREIGN PATENT DOCUMENTS

| | | | |
|---|---|---|---|
| CN | 102057420 | A | 5/2011 |
| CN | 104115213 | A | 10/2014 |

(Continued)

*Primary Examiner* — Rodney Amadiz
(74) *Attorney, Agent, or Firm* — McClure, Qualey & Rodack, LLP

(57) ABSTRACT

An electronic device is provided in this disclosure. The electronic device includes a display panel and a processor. The processor is electrically connected to the display panel. The processor receives image data and calculates a display area occupied by the image data on the display panel according to the image data. Then, the processor adjusts a backlight current value of the display panel according to the display area and an area-current relationship, to adjust the brightness of the display panel. In this way, the brightness of the display panel is consistent when the display panel displays images of different areas. The disclosure also provides a brightness adjustment method of an electronic device.

16 Claims, 5 Drawing Sheets

(56) References Cited

U.S. PATENT DOCUMENTS

| | | | | |
|---|---|---|---|---|
| 2013/0135354 | A1* | 5/2013 | Ookawara | G09G 3/3406 345/660 |
| 2014/0092140 | A1* | 4/2014 | Wadhwa | G09G 3/20 345/660 |
| 2014/0368527 | A1 | 12/2014 | Fujine et al. | |
| 2018/0233093 | A1* | 8/2018 | Chu | G09G 3/3426 |
| 2020/0175944 | A1* | 6/2020 | Sun | G06F 3/013 |

FOREIGN PATENT DOCUMENTS

| | | | |
|---|---|---|---|
| CN | 108428436 | B | 8/2018 |
| CN | 110716349 | A | 1/2020 |

* cited by examiner

ELECTRONIC DEVICE AND BRIGHTNESS ADJUSTMENT METHOD THEREOF

CROSS-REFERENCE TO RELATED APPLICATION

This application claims the priority benefit of Taiwan Application Serial No. 110103720, filed on Feb. 1, 2021, and U.S. provisional application Ser. No. 63/017,135, filed on Apr. 29, 2020. The entirety of the above-mentioned patent applications is hereby incorporated by reference herein and made a part of the specification.

BACKGROUND OF THE INVENTION

Field of the Invention

The disclosure is related to an electronic device and a brightness adjustment method thereof.

Description of the Related Art

To highlight the contrast, an existing high-dynamic-range imaging (HDR) display enhances the contrast by using a local dimming technology. A backlight module lights up a display region according to requirements. Although the local dimming enhances the contrast, for the same display position, the brightness thereof changes as the display region as well as a quantity of light-emitting regions becomes larger. Therefore, the brightness of the display increases as the display region becomes larger. Consequently, the brightness of the display is inconsistent when the display displays images, which brings poor user experiences.

BRIEF SUMMARY OF THE INVENTION

According to first aspect of the disclosure, an electronic device is provided. The electronic device includes a display panel and a processor. The processor is electrically connected to the display panel, wherein the processor receives image data and calculates a display area that occupied by the image data on the display panel according to the image data, and the processor adjusts a backlight current value of the display panel according to the display area and an area-current relationship, to adjust the brightness of the display panel.

According to second aspect of the disclosure, a brightness adjustment method configures for adjusting the brightness of a display panel is provided. The brightness adjustment method comprises: receiving image data; calculating a display area occupied by the image data on the display panel according to the image data; and adjusting a backlight current value of the display panel according to the display area and an area-current relationship, to adjust the brightness of the display panel.

Based on the above, in the disclosure, a display area is determined according to image data and a backlight current value is adjusted according to different display areas, thus to dynamically adjust the brightness of the display panel. In this way, the brightness of the display panel is consistent when the display panel displays images at different areas.

DETAILED DESCRIPTION OF THE EMBODIMENTS

Figure 1:
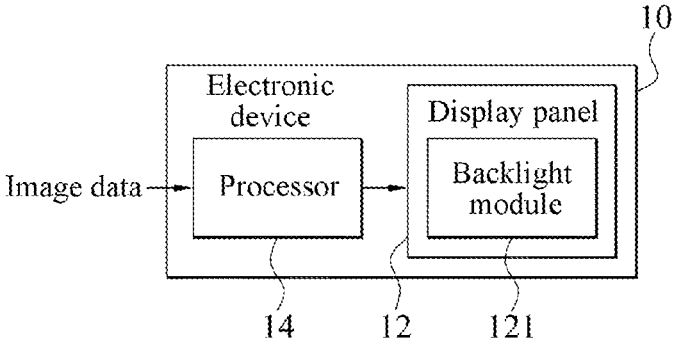
FIG. 1 is a schematic block diagram of an electronic device according to an embodiment of the disclosure.

Referring to FIG. 1, an electronic device 10 includes a display panel 12 and a processor 14. The processor 14 is electrically connected to the display panel 12. In this way, the processor 14 operates according to the received image data, to adjust the brightness of the display panel 12 according to the image data. In an embodiment, the processor 14 is an image processor.

In an embodiment, the electronic device 10 is a LED display, a notebook computer, a tablet computer, a mobile phone, or the like.

Figure 2:
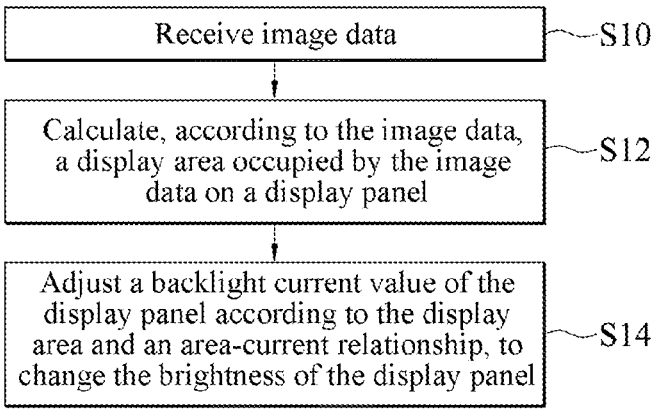
FIG. 2 is a schematic flowchart of a brightness adjustment method according to an embodiment of the disclosure.

Referring to both FIG. 1 and FIG. 2, in the electronic device 10, the processor 14 configures to perform a brightness adjustment method. The brightness adjustment method includes the following steps: in step S10, the processor 14 receives image data. Next, in step S12, the processor 14 calculates a display area occupied by the image data on the display panel 12 according to the received image data. In step S14, the processor 14 adjusts a backlight current value of the display panel 12 according to the display area and an area-current relationship, and the backlight current value is adjusted as $r*I_0$. $I_0$ is an original backlight current value, and the adjustment parameter $r \leq 1$. In this way, the brightness of the display panel 12 is changed by adjusting the backlight current value. Specifically, because the brightness of the display panel 12 increases as the display area becomes larger, and the brightness of the display panel is proportional to the backlight current value, the processor 14 selects an adjustment parameter r according to the display area, and then calculates a current backlight current value at present according to the area-current relationship ($r*I_0$). That is, when different image data is to be displayed, the display panel 12 dynamically adjusts the backlight current value according to display areas of the different image data, to maintain the brightness at the same position consistent.

Figure 3:
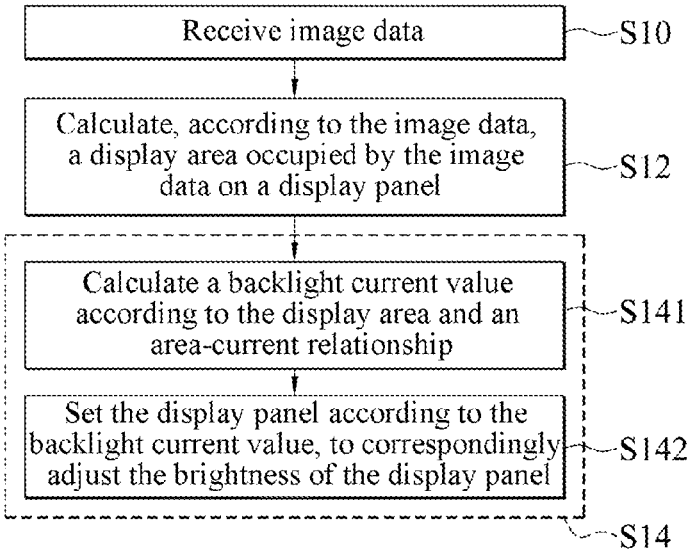
FIG. 3 is a schematic flowchart of a brightness adjustment method according to another embodiment of the disclosure.

In an embodiment, referring to FIG. 1 to FIG. 3, step S14 of adjusting the backlight current value of the display panel 12 according to the display range and the area-current relationship further includes step S141 and step S142. In step S141, the processor 14 calculates the backlight current value according to the display range and the area-current relationship; and in step S142, the processor 14 sets the display panel 12 according to the backlight current value, to correspondingly adjust the brightness of the display panel 12.

Specifically, as shown in FIG. 1, when the display area calculated by the processor 14 increases, the processor 14 reduces the backlight current value of the display panel 12 according to the display area and the area-current relationship (r decreases), to prevent the brightness of the display panel 12 to increase along with the display area. In this way, the brightness of the display panel 12 is turned down by reducing the backlight current value, to keep the current overall brightness consistent with the brightness of a previous display image. Conversely, when the display area calculated by the processor 14 decreases, the processor 14 increases the backlight current value of the display panel 12 according to the display area and the area-current relationship (r increases, and the largest backlight current value is the original backlight current value), to prevent the brightness of the display panel 12 to decrease along with the display area. In this way, the brightness of the display panel 12 is turned up through a higher backlight current value, to keep the current overall brightness consistent with the brightness of a previous display image.

In an embodiment, the display panel 12 further includes a backlight module 121. Therefore, the processor 14 adjusts the brightness of the backlight module 121 according to the backlight current value. The backlight module 121 is limited to a smallest lighted region. In an embodiment, the backlight module is divided into only 1000 regions for lighting, but the resolution of the display panel 12 is far greater than 2000 regions. In this case, the display area does not completely coincide with a lighted area of the backlight module 121. Therefore, the lighted area is further taken into consideration while adjusting the brightness of the display panel 12. Referring to both FIG. 1 and FIG. 4, in step S20, the processor 14 receives image data. In step S22, the processor 14 calculates a display area occupied by the image data on the display panel 12 according to the image data. Subsequently, in step S24, the processor 14 further calculates a lighted area of the backlight module 121 corresponding to the display area according to the display area. In step S26, the processor 14 adjusts a backlight current value of the backlight module 121 of the display panel 12 according to the lighted area corresponding to the display area and an area-current relationship, and the backlight current value is adjusted as $r*I_0$. The adjustment parameter $r \leq 1$. $I_0$ is an original backlight current value. In this way, the brightness of the backlight module 121 is changed according to the adjusted the backlight current value, to make the brightness corresponding to different display areas (lighted areas) at the same position nearly consistent.

Figure 4:
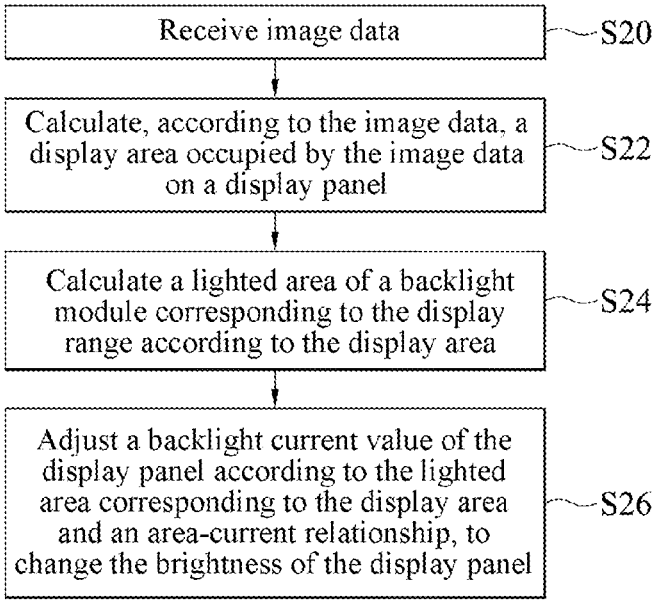
FIG. 4 is a schematic flowchart of a brightness adjustment method according to still another embodiment of the disclosure.
Figure 5:
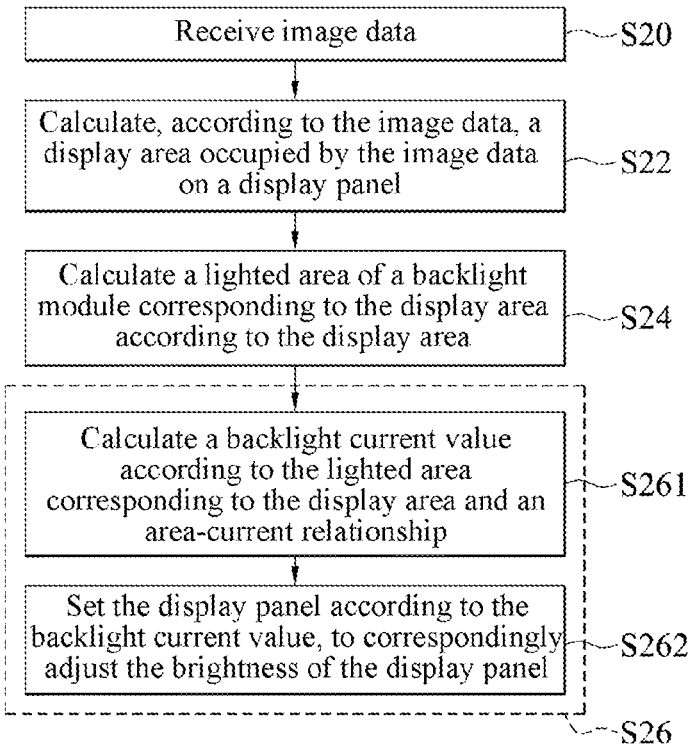
FIG. 5 is a schematic flowchart of a brightness adjustment method according to yet another embodiment of the disclosure.

In an embodiment, referring to FIG. 1, FIG. 4, and FIG. 5, step S26 of adjusting the backlight current value of the display panel 12 according to the lighted area corresponding to the display area and the area-current relationship further includes step S261 and step S262. In step S261, the processor 14 calculates the backlight current value according to the lighted area corresponding to the display area and the area-current relationship; and in step S262, the processor 14 sets the backlight module 121 of the display panel 12 according to the backlight current value. In this way, the backlight module 121 is lighted through the adjusted backlight current value, to correspondingly adjust the brightness of the display panel 12.

Specifically, as shown in FIG. 1, when the display area increases, the corresponding lighted area also increases. To prevent the brightness of the display panel 12 from increasing along with the lighted area, the processor 14 reduces the backlight current value of the display panel 12 according to the lighted area and the area-current relationship (r decreases). In this way, the brightness of the display panel 12 is turned down by reducing the backlight current value, to keep the current overall brightness consistent with the brightness of a previous display image. Conversely, when the display area decreases, the corresponding lighted area also decreases. To prevent the brightness of the display panel 12 from decreasing along with the lighted area, the processor 14 increases the backlight current value of the display panel 12 according to the lighted area and the area-current relationship (r increases, and the largest backlight current value is the original backlight current value). In this way, the brightness of the display panel 12 is turned up through a higher backlight current value, to keep the current overall brightness consistent with the brightness of a previous display image.

In an embodiment, the backlight module 121 further includes a plurality of light emitting diodes (not shown in the figure), and the lighted area of the backlight module 121 corresponds to a quantity of lighted light emitting diodes in the plurality of light emitting diodes. The lighted area is not only relevant to the quantity of the lighted light emitting diodes, but also is determined by a quantity of local dimming regions.

In an embodiment, referring to FIG. 1, FIG. 2, and FIG. 4, there are two manners for adjusting the backlight current value of the display panel 12 shown in step S14 and step S26. One manner is that the processor 14 directly changes a current value to adjust the backlight current value. In an embodiment, the backlight current value is directly reduced from 10 A to 8 A. The other adjustment manner is that the processor 14 adjusts the backlight current value by changing a pulse-width modulation (PWM) setting. In an embodiment, an original setting that a backlight current value of 10 A is outputted at each time point in a specific time interval is adjusted to a setting that a backlight current value of 10 A is outputted at a half of time points in the specific time interval.

Figure 6A:
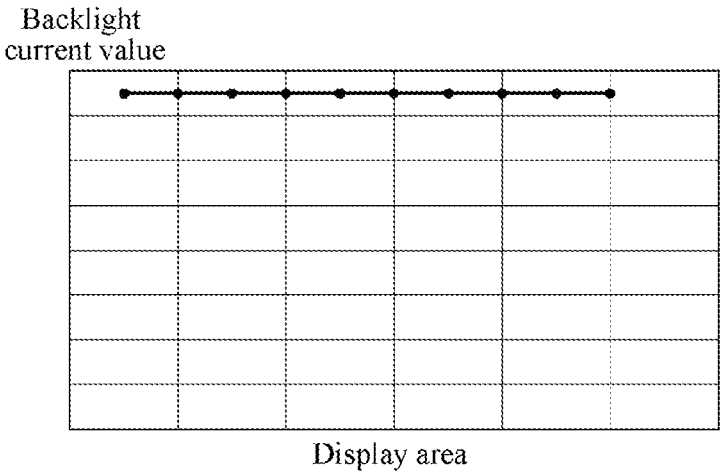
FIG. 6A is a schematic curve diagram of a fixed backlight current value over different display areas according to an embodiment of the disclosure.
Figure 6B:
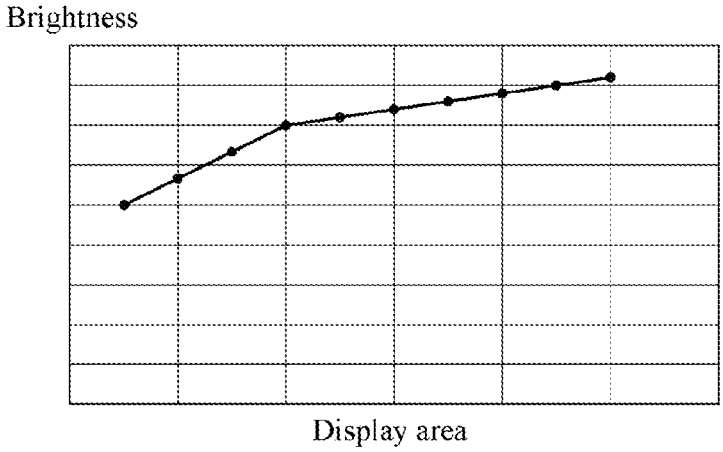
FIG. 6B is a schematic curve diagram of brightness changing over different display areas according to an embodiment of the disclosure.
Figure 7A:
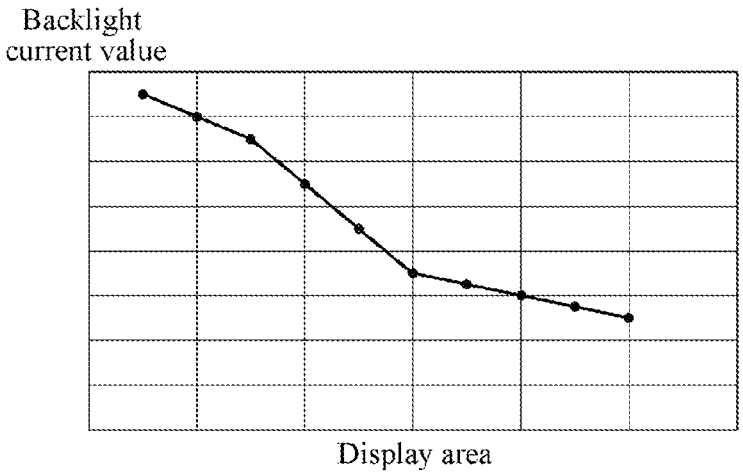
FIG. 7A is a schematic curve diagram of backlight current value changing over different display areas according to an embodiment of the disclosure.
Figure 7B:
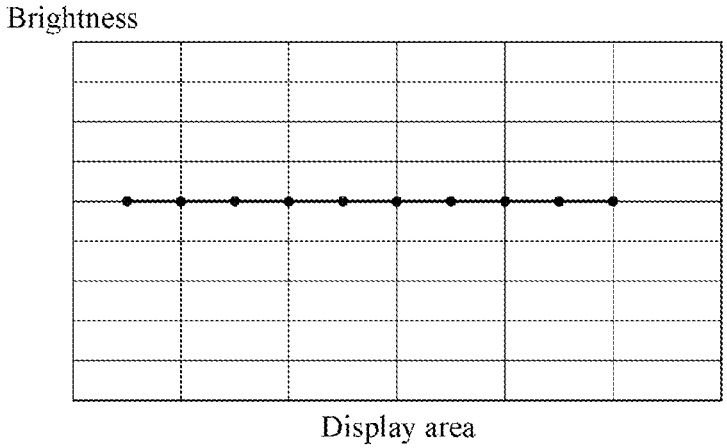
FIG. 7B is a schematic curve diagram of brightness maintaining consistent over different display areas according to an embodiment of the disclosure.

In an embodiment, the area-current relationship is pre-set. Referring to FIG. 1, in a product development stage, a fixed original backlight current value I0 is set by the processor 14, as shown in FIG. 6A. A curve of a relationship between different display areas and corresponding brightness is obtained by measuring the brightness corresponding to the different display areas at the same point on the display panel 12, as shown in FIG. 6B. Generally, the brightness of the display panel 12 increases as the display area becomes larger. In addition, Since the brightness of the display panel 12 is proportional to the backlight current value lighting the backlight module 121, several groups of backlight current values corresponding to different display areas are pre-set, and then other backlight current values corresponding to other display areas are calculated by using a linear interpolation method. The backlight current values corresponding to the display areas are separated into a plurality of segments, and there is a linear relationship between the segments, as shown in FIG. 7A. That is, the relationship curve diagram shows a curve with N slope changes ($N \geq 2$). Herein, an example in which the curve has 3 slope changes is used. The area-current relationship is defined according to a curve drawn based on the foregoing linear interpolation result, and a backlight current value corresponding to each display area is adjusted to r*I0 according to the area-current relationship. In this way, the brightness corresponding to different display areas of the same color image at the same position is consistent, as shown in FIG. 7B.

Based on the above, in the disclosure, a display area is determined according to image data and a backlight current value is adjusted according to different display areas, to dynamically adjust the brightness of the display panel. In this way, the brightness of the display panel is consistent when the display panel displays images of different areas, to avoid the problem that a user is discomfort when watching the images caused by the inconsistency of the brightness of display images.

The embodiments described above are only used for explaining the technical ideas and characteristics of the disclosure to enable a person skilled in the art to understand and implement the content of the disclosure, and are not intended to limit the patent scope of the disclosure. That is, any equivalent change or modification made according to the spirit disclosed in the disclosure shall still fall within the patent scope of the disclosure.

What is claimed is:

1. An electronic device, comprising:

a display panel; and a processor, electrically connected to the display panel, wherein the processor receives image data and calculates a display area occupied by the image data on the display panel according to the image data, and the processor adjusts a backlight current value of the display panel according to the display area and an area-current relationship, to adjust the brightness of the display panel.

2. The electronic device according to claim 1, wherein the display panel further comprises a backlight module, and the brightness of the backlight module is adjusted according to the backlight current value.

3. The electronic device according to claim 2, wherein after the processor calculates the display area occupied by the image data on the display panel, the processor further calculates a lighted area of the backlight module corresponding to the display area according to the display area.

4. The electronic device according to claim 3, wherein the processor adjusts the backlight current value according to the lighted area corresponding to the display area and the area-current relationship, to adjust the brightness of the backlight module according to the adjusted backlight current value.

5. The electronic device according to claim 3, wherein the backlight module further comprises a plurality of light emitting diodes, and the lighted area corresponds to a quantity of lighted light emitting diodes in the plurality of light emitting diodes.

6. The electronic device according to claim 1, wherein the processor adjusts the backlight current value by directly changing a current value.

7. The electronic device according to claim 1, wherein the processor adjusts the backlight current value by changing a pulse-width modulation setting.

8. The electronic device according to claim 1, wherein the processor adjusts the backlight current value of the display panel according to the display area and the area-current relationship further comprises:

calculating, by the processor, the backlight current value according to the display area and the area-current relationship; and setting, by the processor, the display panel according to the backlight current value, to correspondingly adjust the brightness of the display panel.

9. A brightness adjustment method of an electronic device, used for adjusting the brightness of a display panel, wherein the brightness adjustment method comprises:

receiving image data;

calculating a display area occupied by the image data on the display panel according to the image data; and adjusting a backlight current value of the display panel according to the display area and an area-current relationship, to adjust the brightness of the display panel.

10. The brightness adjustment method according to claim 9, wherein the display panel further comprises a backlight module, and the brightness of the backlight module is adjusted according to the backlight current value.

11. The brightness adjustment method according to claim 10, wherein after calculating the display area occupied by the image data on the display panel, the method further comprises: calculating a lighted area of the backlight module corresponding to the display area according to the display area.

12. The brightness adjustment method according to claim 11, wherein adjusting the backlight current value of the display panel according to the display area and the area-current relationship further comprises:

adjusting the backlight current value according to the lighted area corresponding to the display area and the area-current relationship, to adjust the brightness of the backlight module according to the adjusted backlight current value.

13. The brightness adjustment method according to claim 11, wherein the backlight module further comprises a plurality of light emitting diodes, and the lighted area corresponds to a quantity of lighted light emitting diodes in the plurality of light emitting diodes.

14. The brightness adjustment method according to claim 9, wherein in adjusting the backlight current value of the display panel, the backlight current value is adjusted by directly changing a current value.

15. The brightness adjustment method according to claim 9, wherein in adjusting the backlight current value of the display panel, the backlight current value is adjusted by changing a pulse-width modulation setting.

16. The brightness adjustment method according to claim 9, wherein adjusting the backlight current value of the display panel according to the display area and the area-current relationship further comprises:

calculating, by a processor, the backlight current value according to the display area and the area-current relationship; and setting, by the processor, the display panel according to the backlight current value, to correspondingly adjust the brightness of the display panel.

* * * * *